US005622655A

United States Patent [19]

Cincotta et al.

[11] Patent Number: 5,622,655

[45] Date of Patent: Apr. 22, 1997

[54] SANITARY DIRECT CONTACT STEAM INJECTION HEATER AND METHOD

[75] Inventors: Bruce A. Cincotta, Wauwatosa; Marc K. Mueller, Pewaukee, both of Wis.

[73] Assignee: Hydro-Thermal Corporation, Waukesha, Wis.

[21] Appl. No.: 419,177

[22] Filed: Apr. 10, 1995

[51] Int. Cl.[6] ..... B01F 3/04

[52] U.S. Cl. ..... 261/76; 261/DIG. 76; 261/DIG. 78

[58] Field of Search ..... 261/76, DIG. 76, 261/DIG. 78

[56] References Cited

U.S. PATENT DOCUMENTS

| | | | |
|---|---|---|---|
| 1,315,931 | 9/1919 | Poppink | 261/DIG. 76 |
| 1,846,220 | 2/1932 | McCune, Jr. | 261/DIG. 76 |
| 2,483,426 | 10/1949 | Moore | 261/DIG. 76 |
| 3,331,590 | 7/1967 | Battenfeld et al. | 261/DIG. 78 |
| 3,984,504 | 10/1976 | Pick | 261/76 |
| 4,198,357 | 4/1980 | Berriman et al. | 261/DIG. 78 |
| 4,473,512 | 9/1984 | Pick et al. | 261/62 |
| 4,773,827 | 9/1988 | Zaiser | 417/183 |
| 4,931,225 | 6/1990 | Cheng | 261/DIG. 78 |
| 5,395,569 | 3/1995 | Badertscher et al. | 261/DIG. 78 |

FOREIGN PATENT DOCUMENTS

| | | | |
|---|---|---|---|
| 201014 | 3/1907 | Germany | 261/DIG. 76 |

OTHER PUBLICATIONS

Hydro–Thermal Brochure, "Efficient Steam Heating of Liquids and Slurries", Bulletin H120.

Hydro–Thermal Brochure, "Improving Efficiency and Productivity while Lowering Production Costs", Bulletin H150.

Hydro–Thermal Brochure, "Hot Liquids On Demand", Form H112.

Hydro–Thermal, "Automatic Temperature Control", Application Bulletin A–3.

Hydro–Thermal, "Automatic Intermittent Heating", Application Bulletin A–11.

*Primary Examiner*—Tim R. Miles

*Attorney, Agent, or Firm*—Andrus, Sceales, Starke & Sawall

[57] ABSTRACT

A direct contact steam injection heater with a coaxial steam nozzle has a converging/diverging combining tube. The converging/diverging combining tube eliminates the need for an adjustable combining tube sleeve to accommodate various flow rates of a liquid or slurry entering into the heater. The heater is especially well suited for sanitary applications because, without the combining tube sleeve, the heater can be made so that surfaces in contact with the liquid or slurry do not have pockets or folds in which liquid or particulates can accumulate. Contact surfaces in the heater are substantially self-cleaning because of turbulent mixing action, and the heater can be quickly disassembled and reassembled for manual cleaning.

13 Claims, 2 Drawing Sheets

FIG. 1
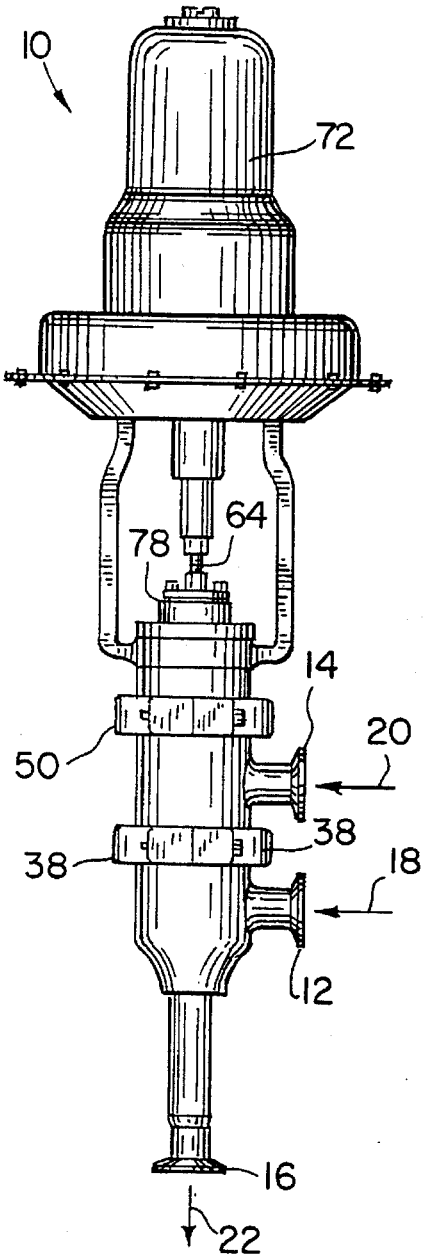
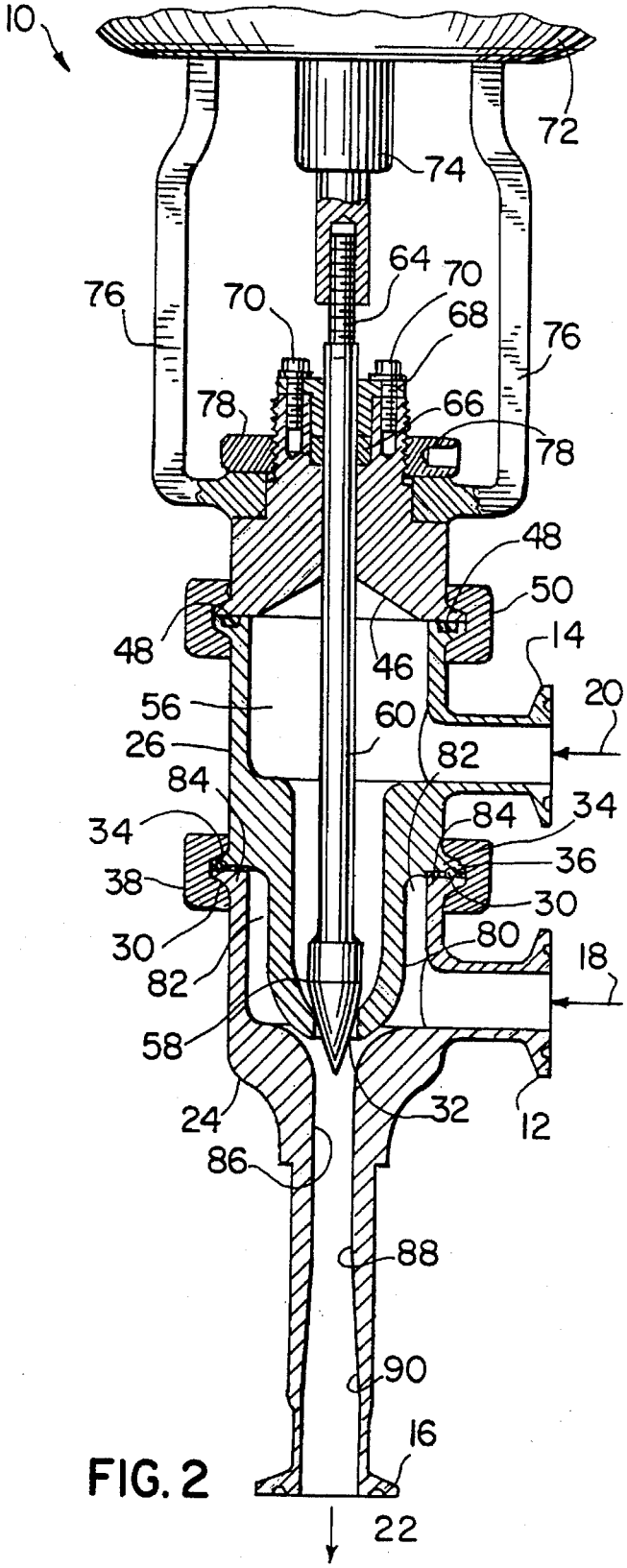
FIG. 2

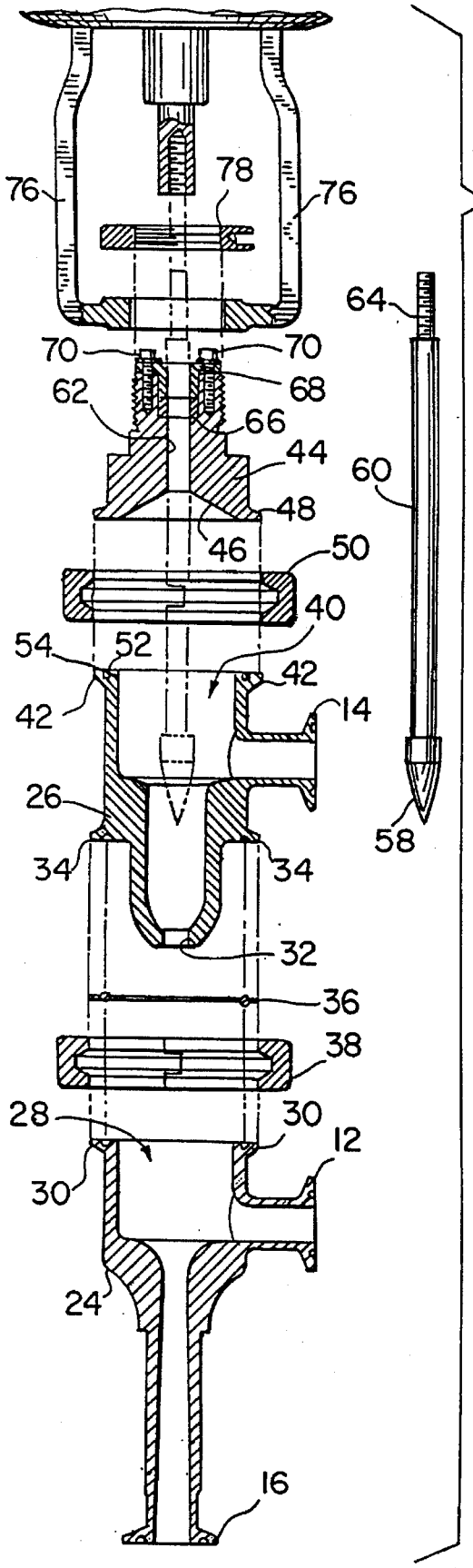
FIG. 3
FIG. 4
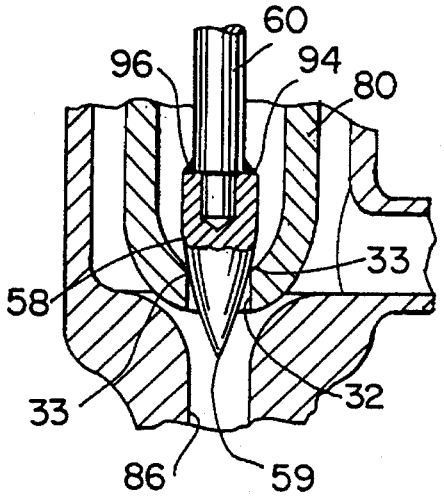
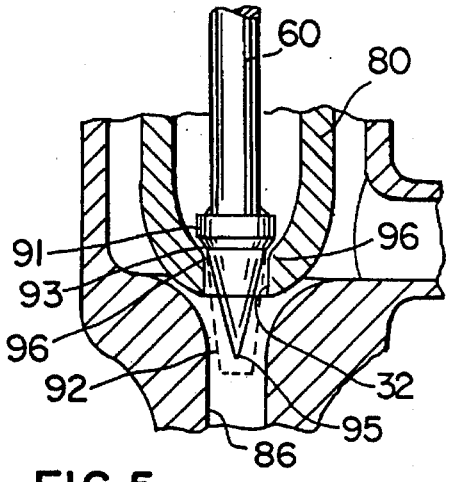
FIG. 5

SANITARY DIRECT CONTACT STEAM INJECTION HEATER AND METHOD

FIELD OF THE INVENTION

The invention relates to direct contact steam injection heaters. The invention is particularly useful for heating liquids or slurries in sanitary heating applications.

BACKGROUND OF THE INVENTION

In direct contact steam injection heaters, steam is directly mixed with a liquid or slurry to heat the liquid or slurry. Direct contact steam injection heaters are very effective at transferring heat energy from steam to the liquid or slurry. Direct contact steam injection heaters provide rapid heat transfer with virtually no heat loss to the atmosphere, and also transfer both the latent and the available sensible heat of the steam to the liquid or slurry.

There are many sanitary applications in which steam injection heating can be useful. For instance, steam injection heaters can be used to heat water (or water mixed with additives) for cleaning purposes, to heat water in a kettle for cooking food, to heat a slurry, or to heat just about anything in a pulp. In each of these applications, a sanitary heater can encounter a wide range of liquid flows, and sometimes even a wide range of steam pressures and temperatures. It is desirable that the temperature of the heated liquid or slurry be precisely controlled even with varying liquid flows or steam pressures and temperatures. It is also desirable that the heater maintain stable liquid flow even over a wide range of flow rates.

There are strict requirements for apparatus used in sanitary applications. For instance, no threads, folds or pockets in which fluids or particulates can accumulate may be present in the apparatus. It is also desirable that the contact surfaces be self-cleaning. If manual cleaning of contact surfaces is needed, easy disassembly of the apparatus is required. The apparatus must also be self-draining when installed. One type of direct contact steam injection heater, which is disclosed in U.S. Pat. No. 4,473,512, has been used in sanitary applications. The sanitary steam injection heater disclosed in U.S. Pat. No. 4,473,512 can be easily disassembled using quick disconnect couplings or clamps, but has many intricate mechanical parts that require extensive manual cleaning.

SUMMARY OF THE INVENTION

The invention is a direct contact steam injection heater in which steam is injected through a steam nozzle into a flow of a liquid or a slurry that is flowing through a combining tube. The combining tube has an inlet for the liquid or slurry and an outlet, and the steam nozzle is coaxial with the combining tube outlet. The flow area of the combining tube continuously converges from the inlet to a direct mixing section, thus accelerating the liquid or slurry flowing into the direct mixing section. Steam is injected into the accelerated liquid or slurry slightly upstream of the direct mixing section. The steam flow from the nozzle is preferably choked, and also preferably exits the nozzle at a supersonic speed. The high speed steam shears the liquid or slurry into tiny droplets to create a large surface area for rapid and efficient heat transfer. The amount of steam injected into the liquid or slurry can be precisely modulated by adjusting the position of a nozzle plug in relation to a steam exit of the nozzle. The flow area in the direct mixing section preferably remains constant for a sufficient length to facilitate a substantial amount of direct mixing. Downstream of the direct mixing section, the combining tube slowly diverges to the combining tube outlet. The combining tube preferably diverges at 3° in the diverging section downstream of the direct mixing section. As the heated fluid flows through the diverging section of the combining tube, the pressure in the liquid or slurry increases, thus promoting complete steam condensation.

Prior art direct contact steam injection heaters having coaxial steam nozzles have generally used an adjustable combining tube sleeve to restrict liquid or slurry flow into the combining tube. In this manner, the flow velocity of the liquid or slurry could be controlled so that proper mixing with the steam would occur in the combining tube. Conventional direct contact steam injection heaters with an adjustable combining tube, however, are not well suited for sanitary applications because the adjustable combining tube sleeve introduces additional creases, folds and pockets in which liquid or particulates can accumulate. Also, such devices are not normally easy to disassemble for manual cleaning.

In one aspect, the invention eliminates the need for an adjustable combining tube sleeve in a direct contact steam injection heater with a coaxial steam nozzle. The converging section of the combining tube ensures that the flow speed of the liquid or slurry is high enough (e.g. greater than about ten feet per second) when the high velocity steam is injected so that the liquid or slurry flow through the heater remains stable over a wide range of flow rates (e.g. stable over a range of 6 gallons per minute minimum flow to 250 gallons per minute maximum flow). Depending on the flow rate of the liquid or slurry into the heater, which can vary substantially, the converging section and the direct mixing section of the combining tube might not be optimized for complete mixing and steam condensation at the particular flow rate. The combining tube, therefore, incorporates a slowly diverging section downstream of the direct mixing section to increase the pressure in the liquid or slurry, and promote steam condensation.

This converging/diverging combining tube configuration eliminates the need for an adjustable combining tube sleeve to accommodate various flow rates of the liquid or slurry into the heater. Without the combining tube sleeve, the heater can be made so that surfaces in contact with the liquid or slurry do not have pockets or folds in which liquid or particulates can accumulate. The surfaces in contact with the liquid or the slurry are, in general, substantially self-cleaning because of the turbulent mixing action between the liquid or slurry and the steam.

In another aspect, the direct contact steam injection heater is configured so that the heater can be disassembled easily for manual cleaning. In this aspect, the heater has a combining tube, a coaxial steam nozzle, and a head, which are clamped together with quick disconnect clamps. The combining tube has a nozzle opening and a flange circumventing the periphery of the nozzle opening. The steam nozzle has a first nozzle flange that circumvents the nozzle which is clamped to the combining tube flange to attach the combining tube and the nozzle together. The nozzle also has a head opening and a second nozzle flange circumventing the periphery of the head opening. The head has a steam contact surface and a head flange circumventing the periphery of the steam contact surface. The head flange is clamped to the second nozzle flange to attach the nozzle and the head together. A steam chamber is provided within the attached nozzle and head. The heater also has a plug and an integral plug stem. The plug resides within the steam chamber in cooperation with the steam exit in the nozzle, and the plug stem passes through a plug stem guide hole in the head. The amount of flow through the nozzle exit is preferably modulated by adjusting the position of the plug relative to an exit in the nozzle, either manually or automatically in response to a control signal. Also, it is preferred that the nozzle exit be in the shape of a cylinder, because flow mechanics through cylindrical nozzle exits are known in the art.

BRIEF DESCRIPTION OF THE DRAWINGS

FIG. 1 is a side elevational view of a direct contact steam injection heater in accordance with the invention.

FIG. 2 is a longitudinal cross-sectional view of the direct contact steam injection heater shown in FIG. 1.

FIG. 3 is an exploded view of the cross-section shown in FIG. 2.

FIG. 4 is a detailed view of a portion of the direct contact steam injection heater shown in FIGS. 1 and 2.

FIG. 5 is a detailed view similar to FIG. 4 showing a nozzle plug with an alternative geometry.

DETAILED DESCRIPTION OF THE DRAWINGS

The drawings illustrate a direct contact steam injection heater 10 that has a liquid inlet 12, a steam inlet 14 and a heated liquid outlet 16. A liquid or slurry flows into the direct contact steam injection heater 10 through liquid inlet 12 in the direction of arrow 18. Steam for heating the liquid/slurry flows into the heater 10 through the steam inlet 14 in the direction of arrow 20. The steam heated liquid/slurry outputs through the outlet 16 in the direction of arrow 22.

The heater 10 shown in the drawings can be sized to accommodate a wide range of maximum liquid flow rates. Many sanitary applications require no more than a 100 gallons per minute maximum liquid/slurry flow rate. Inasmuch as the heater 10 is particularly useful for sanitary applications, dimensions for a 100 gallon per minute maximum flow rate heater 10 are used as examples in this description where an example is helpful in describing the invention.

The heater 10 has a combining tube 24 in which the liquid/slurry and steam are combined or mixed. The combining tube has a liquid inlet 12, a nozzle opening 28 for a steam nozzle 26, and an outlet 16. The combining tube 24 also has a combining tube flange 30 circumventing a peripheral edge of the nozzle opening 28.

The steam nozzle 26 has a steam inlet 14, and a nipple portion 80 with an exit 32. The nozzle exit 32 is preferably cylindrical in shape, and also preferably coaxial with the combining tube outlet 16. The steam nozzle 26 also has a first nozzle flange 34 that circumvents the nozzle housing. A gasket 36 is located between the combining tube flange 30 and the first nozzle flange 34. A quick disconnect clamp 38 clamps the flanges 30 and 34 together with the gasket 36 therebetween to attach the nozzle 26 and the combining tube 24. The gasket 36 prevents liquid or particulates from accumulating in the crease between the flanges 30 and 34. As can be seen in FIG. 3, the quick disconnect clamp 38 can be removed to allow easy access inside the combining tube 24 and the nozzle 26 for manual cleaning.

The heater 10 also has a head 44. The head 44 has a steam contact surface 46 and a head flange 48 circumventing a peripheral edge of the steam contact surface 46. The nozzle 26 has a head opening 40 and a second nozzle flange 42 circumventing the head opening 40. The head 44 is attached to the nozzle 26 by clamping together flanges 42 and 48. A quick disconnect clamp 50 is used so that the head 44 and the nozzle 26 can be easily detached to facilitate manual cleaning. The edge of the nozzle 26 adjacent to the second nozzle flange 42 (i.e., the nozzle flange 42 used to attached the head 44) has a groove 52 in which an O-ring 54 is placed. The groove 52 and the O-ring 54 are preferably located towards the inside surface of the nozzle 26.

When the head 44 is attached to the nozzle 26, a steam chamber 56 is formed within the nozzle 26 and the steam contact surface 46 of the head 44. A nozzle plug 58 with an integral plug stem 60 is located primarily within the steam chamber 56. Referring to FIG. 4, the plug stem 60 has a cylindrical tip 94 with a reduced diameter to which the plug 58 is mounted. A weld 96 is placed around the plug stem 60 adjacent to the plug 58 to eliminate any creases that might be present.

Referring to FIGS. 2 and 3, head 44 has a plug stem guide hole 62 through which the plug stem 60 is slidably mounted. It is desirable that the head 44 be a separate physical part from the nozzle 26 so that plug 58 and integral plug stem 60 can be inserted into the steam chamber 56. The plug stem 60 has a threaded end 64 opposite the plug 58. The threaded end 64 of the plug stem 60 is exposed outside of the steam chamber 56. The outside end of the plug stem guide hole 62 is enlarged to accommodate the installation of packing material 66 around the plug stem 60. The packing 66 seals steam from escaping through the plug stem guide hole 62. In a sanitary or food application, it is preferred that the packing material 66 be a food grade packing. The packing material 66 is secured with a packing follower 68 that is attached to the head 44 with screws 70.

The threaded end 64 of the plug stem 60 is attached to an actuator 72. For a heater 10 with a 100 gallons per minute maximum liquid/slurry flow rate, the actuator 72 preferably has an actuator arm 74 with a one inch axial travel path. The actuator 72 has an attachment yoke 76 that is secured to the head 44 with a threaded collar 78. The threaded collar 78 can be locked into place.

It is preferred that all the body sections of the heater 10 (i.e. the combining tube 24, the nozzle 26, and the head 44), be investment cast from 316 stainless steel. Machining may be required to alter specific dimensions and for creating the gasket 36 groove and the O-ring 54 groove 52. The liquid contact surfaces on the nozzle 26 and the combining tube 24 should be polished to a 4 RMS finish which is shiny bright. It is preferred that the liquid inlet 12 and the heater outlet 16 be purchased parts per industry standards for these connections, and that the parts 12 and 16 be welded to the combining tube 24. Likewise, it is preferred that the steam inlet 14 be a purchased part per industry standard, and that the inlet 14 be welded to the nozzle 26.

As can be seen in FIG. 3, the assembly of the heater 10 is relatively mistake-proof inasmuch as the parts can be assembled in only one manner.

Referring again to FIG. 2, the fully assembled heater 10 inputs a liquid or slurry through liquid inlet 12 in the direction of arrow 18, which is preferably at a 90° angle to the direction of liquid/slurry flow through the outlet 16 of the heater 10. The liquid/slurry flowing into the heater 10 surrounds the nipple portion 80 of the nozzle 26. Most of the liquid/slurry flows around the nipple 80 of the nozzle 26, and directly through the combining tube 24 towards the combining tube outlet 16. Some of the liquid/slurry accumulates temporarily in a back volume 82 between the nipple 80 of the nozzle 26 and a part 84 of the combining tube 24 near the combining tube flange 30. In general, the flow area of the liquid/slurry flowing in from the inlet 12 converges until a direct mixing section 86 in the combining tube 24.

The converging flow area accelerates the liquid/slurry so that the liquid/slurry is flowing at the preferred rate of about 6 to 30 feet per second in the direct mixing section 86. For example, in a sanitary heater 10 designed for a liquid/slurry flow in the range of 6 to 100 gallons per minute, the diameter of the direct mixing section 86 is preferably 0.52 inches whereas the diameter of the inlet 12 is preferably 0.83 inches. These dimensions are preferred because these dimensions provide a 9 feet per second flow speed in the direct mixing section 86 when the liquid/slurry flow into the inlet 12 is at 6 gallons per minute.

In FIG. 2, the plug 58 is shown to be closed against the nozzle exit 32. When the plug 58 is retracted from the exit 32, steam in the steam chamber 56 can exit through the nozzle exit 32. The actuator 72 controls the position of the plug 58 with respect to the nozzle exit 32, and thus adjusts the steam flow area through the nozzle exit 32.

The nozzle exit 32 and the plug 58 are dimensioned so that the desired amount of steam flow exits through the exit 32 under choked conditions. For example, in a sanitary heater 10 designed for steam having a temperature in the range of 240°–450° F. and a pressure in the range of 5–150 psi, the diameter of the cylindrical exit 32 is preferably 0.84 inches, and the length of the cylindrical exit 32 is preferably 0.33 inches. The plug 58 is preferably a rectilinear cone having a base diameter of 0.75 inches. The plug 58 cone can be contoured, however, as shown in FIGS. 2 and 4.

Steam exits through the nozzle exit 32 under choked flow conditions preferably at a supersonic speed in the range of 1500 to 2000 feet per second. The high speed steam from the nozzle exit 32 shears the liquid/slurry into droplets, and creates a homogeneous blend of steam and liquid/slurry in the direct mixing section 86. As the homogeneous blend flows through the direct mixing section 86, heat is transferred from the steam to the liquid/slurry and the steam condenses. The diameter of the direct mixing section 86 is preferably constant, but a constant diameter direct mixing section 86 is not required. Beginning at a point 88, the combining tube 24 diverges slowly to the combining tube outlet 16 as the combining tube 24 extends downstream of the direct mixing section 86. In the diverging section 90 of the combining tube 24, the speed of the liquid/slurry flowing through combining tube 24 decreases. The decrease in flow speed causes the pressure of the liquid/slurry to increase. This pressure increase in the diverging section 90 of the combining tube 24 promotes further steam condensation. It is preferred that the diverging section 90 of the combining tube 24 diverge slowly to prevent flashing or other instabilities. The combining tube 24 preferably diverges at 3° in the diverging section 90.

The combining tube 24 cannot be adjusted in the field as with other prior art direct contact steam injection heaters having coaxial steam nozzles using adjustable combining tube sleeves. However, the converging/diverging configuration of combining tube 24 allows the combining tube 24 to operate over a wider range of flow rates and still maintain stability in the liquid/slurry flow. In addition, the contact surfaces in the heater 10 are generally self-cleaning because of the combination of smooth surfaces and turbulent mixing.

The temperature of the heated liquid/slurry outputting the heater 10 through outlet 16 can be monitored by a temperature sensor located downstream of the heater 10. A temperature signal from the temperature sensor would normally be transmitted to a control system, which would normally output a control signal to the actuator 72. In response to the control signal, the actuator 72 can adjust the position of the plug 58 to modulate the amount of steam exiting the nozzle exit 32 into the liquid/slurry, and thereby regulate the temperature of the liquid/slurry flowing from the heater 10. The heater 10 as shown in the drawings has an automatically controlled actuator 72 for adjusting the position of the plug 58, however, the invention is not limited to a heater 10 having an automatically controlled actuator. The position of the plug 58 can be adjusted manually.

The sensitivity of the heater 10, and the maximum temperature rise of liquid/slurry flowing through the heater 10 are related to the liquid/slurry flow rate through the heater 10 and also the temperature, pressure and amount of steam injected into the liquid/slurry. In many applications, a nozzle plug 58 such as shown in FIGS. 2 and 4 is appropriate to modulate the amount of steam injected into the liquid/slurry. Note that in FIGS. 2 and 4, the point 59 of a fully retracted plug 58 would preferably be located in the plane passing through points 33 of the cylindrical nozzle exit 32.

FIG. 5 shows an alternative plug 91 having a stop 93. The stop 93 contacts the inside surface of the nozzle nipple 80 when the plug 91 is fully closed. The point 95 of a fully retracted plug 91 would preferably be located in the plane passing through points 96 of the cylindrical nozzle exit 32. As shown in phantom in FIG. 5, the plug 58 can be replaced with a plug 92 that is thicker and longer. The plug 92 shown in phantom in FIG. 5 allows less steam to flow through the nozzle exit 32 when the plug 92 is fully retracted. A fully retracted plug 92 would preferably be located partially within the cylindrical nozzle exit 32. Although a heater 10 with plug 92 will not be able to inject as much steam into the liquid/slurry, the heater 10 with plug 92 should be able to modulate liquid/slurry output temperatures more accurately.

The heater 10 is self-draining as long as the heater is vertical as shown in FIG. 2 or tilted so that the liquid inlet 12 and steam inlet 14 are facing downward. Note that the body sections of the heater 10 (i.e. the combining tube 24, the nozzle 26 and the head 44) can be rotated 360° to facilitate installation and self-draining.

While a preferred embodiment of the invention has been shown in connection with a direct contact steam injection heater for sanitary applications, it should be noted that the invention is not limited to sanitary heaters. The invention can also be useful in a variety of industrial applications. It should be recognized that various equivalents, alternatives and modifications are possible and should be considered to be within the scope of the appended claims.

We claim:

1. A direct contact steam injection heater comprising:

a non-adjustable, fixed combining tube having an inlet and an outlet, the flow area of the combining tube converging from the inlet to a direct mixing section and slowly diverging downstream of the direct mixing section to the outlet, the direct mixing section having a constant flow area along the direction of flow through the combining tube between the converging section and the diverging section of the combining tube;

a coaxial steam nozzle that discharges steam coaxially in the direction which liquid flows through the combining tube into the converging section of the combining tube immediately upstream of the direct mixing section, the steam exiting the nozzle at a speed greater than or equal to sonic velocity under choked conditions; and a plug contained within the nozzle that can be adjusted to modulate the amount of steam discharged from the nozzle.

2. A direct contact steam injection heater as recited in claim 1 wherein the plug is integral with a plug stem and the direct contact steam injection heater further comprises:

a head which has a plug stem guide hole, the head being attached to the nozzle in such a manner to provide an internal steam chamber therein, and the plug stem being slidably mounted through the plug stem guide hole in the head so that the plug is located within the steam chamber and an end of the plug stem is exposed outside of the steam chamber; and an actuator attached to the exposed end of the plug stem for adjusting the position of the plug.

3. A direct contact steam injection heater as recited in claim 1 wherein the combining tube diverges downstream of the direct mixing section at approximately 3° to the outlet.

4. A direct contact steam injection heater as recited in claim 1 wherein the steam exits from the nozzle through a cylindrical shaped nozzle exit.

5. A direct contact steam injection heater as recited in claim 1 wherein the plug is generally cone-shaped.

6. A direct contact steam injection heater comprising:

a combining tube having an inlet, an outlet, a nozzle opening, and a combining tube flange that circumvents a peripheral edge of the nozzle opening;

a steam nozzle having a steam inlet, a nozzle exit coaxial with the combining tube outlet, a first nozzle flange circumventing the nozzle downstream of the steam inlet, a head opening and a second nozzle flange circumventing a peripheral edge of the head opening;

a plug and an integral plug stem;

a head having a steam contact surface, a head flange circumventing a peripheral edge of the steam contact surface, and a plug stem guide hole through which the plug stem is slidably mounted; and a first clamp that attaches the nozzle and the combining tube by clamping together the combining tube flange and the first nozzle flange; and a second clamp that attaches the nozzle and the head to provide an internal steam chamber in which the plug resides, the second clamp clamping together the second nozzle flange and the head flange.

7. A direct contact steam injection heater as recited in claim 6 wherein an O-ring is located between the steam nozzle and the head.

8. A direct contact steam injection heater as recited in claim 6 wherein the nozzle steam inlet and the combining tube inlet extend perpendicularly in the same direction from a longitudinal axis of the plug stem and the combining tube outlet.

9. A method for heating a liquid with steam comprising the steps of:

flowing steam into a nozzle at a sufficient pressure so that the flow of steam from the nozzle is choked;

flowing liquid into a combining tube having a fixed geometry, including a converging section to accelerate the flow of liquid to a speed at least 6 feet per second, a direct mixing section having a constant flow area, and a diverging section;

flowing the accelerated liquid through the combining tube in a first direction;

injecting steam from the nozzle coaxially in the first direction into the flow of liquid through the combining tube after the flow of liquid has been accelerated to create a homogeneous blend;

modulating the amount of steam injected into the liquid flowing through the combining tube by adjusting the position of a nozzle plug in relation to a nozzle exit through which the choked-flow steam is injected into the flow of liquid through the combining tube to create the homogeneous blend;

flowing the homogeneous blend through the direct mixing section of the combining tube without converging the flow of the homogeneous blend; and slowly diverging the flow of the homogeneous blend in the diverging section to increase pressure in the homogeneous blend and promote further steam condensation in the homogeneous blend without restricting the flow of the homogeneous blend through the combining tube.

10. A method as recited in claim 9 wherein the liquid is a slurry.

11. A method as recited in claim 9 wherein the position of the nozzle plug is adjusted manually.

12. A method as recited in claim 9 wherein the position of the plug is adjusted by an actuator in response to a control signal.

13. A method as recited in claim 9 wherein the liquid is flowed through the conveying flow area to accelerate the flow of liquid to a speed between 6 to 30 feet per second.

* * * * *